United States Patent [19]

Beziat

[11] 4,189,810

[45] Feb. 26, 1980

[54] ASSEMBLY ELEMENTS, INTER ALIA FOR SCAFFOLDING

[75] Inventor: Bernard Beziat, Coye-La-Foret, France

[73] Assignee: Societe Nouvelle des Echafaudages Tubulaires Mills, Le Bourget, France

[21] Appl. No.: 911,455

[22] Filed: Jun. 1, 1978

[30] Foreign Application Priority Data

Jun. 23, 1977 [FR] France ..... 77 19272

[51] Int. Cl.[2] ..... A44B 24/00

[52] U.S. Cl. ..... 24/249 R; 24/248 E; 403/49; 403/344

[58] Field of Search ..... 24/249 R, 248 E, 251, 24/268, 25, 132 WL; 403/49, 344

[56] References Cited

U.S. PATENT DOCUMENTS

| | | | |
|---|---|---|---|
| 1,050,816 | 1/1913 | Deslauriers | 24/268 |
| 1,564,382 | 12/1925 | Treiman | 24/249 R X |
| 1,677,623 | 7/1928 | Eilar | 24/25 X |
| 3,266,208 | 8/1966 | Maggs et al. | 403/49 X |
| 3,449,022 | 6/1969 | Minor | 403/344 X |
| 3,737,180 | 6/1973 | Hayes, Jr. et al. | 24/249 R X |
| 3,916,507 | 11/1975 | McGrath | 403/344 X |

*Primary Examiner*—Philip C. Kannan

*Attorney, Agent, or Firm*—Ostrolenk, Faber, Gerb & Soffen

[57] ABSTRACT

An assembly element, inter alia for scaffolding, used (a) for clamping a cylindrical element after engaging axially or laterally on the cylindrical element and (b) for securing one or more transverse elements on to the cylindrical element, said assembly element comprising two half-rings interconnected by two pins, each half-ring having a deformable inner part adapted to bear against the surface cf the cylindrical element and an outer part adapted to co-operate with the inner part to bound spaces to receive the ends of one or more transverse elements, at least one of the two pins being adapted to tighten the two half-rings when the pin is moved with respect thereto.

10 Claims, 7 Drawing Figures

ASSEMBLY ELEMENTS, INTER ALIA FOR SCAFFOLDING

The invention relates to assembly elements used (a) for clamping a cylindrical element (having a circular or other cross-section) after axially or laterally engaging the cylindrical element and (b) for securing one or more transverse elements to the cylindrical element.

The invention applies more specifically to assembly components for scaffolding used (a) to clamp a tubular vertical upright after axially or laterally engaging the tubular vertical upright and (b) for securing the upright to one or more transverse connecting and/or wind-bracing elements such as longitudinal members or cross-members and/or diagonal members.

Some known assembly elements of the same kind comprise female or male parts permanently secured to the cylindrical element, e.g. by welding, to co-operate with male or female parts borne by the transverse elements to be secured. This method has a number of disadvantages, i.e.:

A considerable increase in the cost of manufacturing the cylindrical elements;

A limitation in the possible forms of assembly, since the cylindrical elements can have only a limited number of attached female or male parts;

An increase in the weight of the cylindrical elements, and

Difficulty in handling or storing the cylindrical elements owing to the attached female or male parts.

Other known assembly elements of the same kind comprise components which are bolted together. This method has a number of disadvantages, i.e.:

The assembly elements are relatively expensive to manufacture;

They take a considerable time to assemble, and special tools are needed.

The aim of the invention is to obviate the disadvantages of the known assembly elements. A first aim is to construct an assembly element which is inexpensive to manufacture. A second aim is to construct an assembly element which can be used with a wide variety of assembly operations. Another aim is to avoid the use of cylindrical elements which are difficult to manufacture. Another aim is to avoid increasing the weight of the cylindrical elements. Another aim is to avoid the use of cylindrical elements which are complicated to handle or store. Another aim is to construct assembly elements which can be assembled without special tools.

The assembly element according to the invention is characterised in that it mainly comprises two half-rings interconnected by two pins, each half-ring having a deformable inner part adapted to bear against the surface of the cylindrical element and an outer part adapted to co-operate with the inner part to bound spaces to receive the ends of one or more transverse elements, at least one of the two pins being adapted to tighten the two half-rings when the pin is moved with respect thereto.

As can be seen, the tightening results (a) in securing the two half-rings with respect to the cylindrical element and (b) clamping the ends of the transverse elements between the inner part and the outer part of the two half-rings. The operation can be performed simply by moving one of the two pins in either direction, using an ordinary hammer.

According to an advantageous feature of the invention, one of the two pins is actuated so that when it is axially moved with respect to the two half-rings it comes loose from one of them so that the two half-rings can open by pivoting around the above pin.

According to another advantageous feature, the inner part of the two half-rings is made easily deformable by an axial slot formed in the centre region of the aforementioned inner part.

In order axially to lock the two half-rings on to the vertical element, the vertical element is advantageously formed with relief patterns which engage in apertures formed in the inner part of each half-ring.

In addition to the aforementioned features, the invention comprises other features which are preferably used at the same time and will be described in greater detail hereinafter.

The invention can in any case be understood from the following description and accompanying drawings, the description and drawings relating to a preferred embodiment of the invention and of course being non-limitative. in the drawings.

Figure 1:
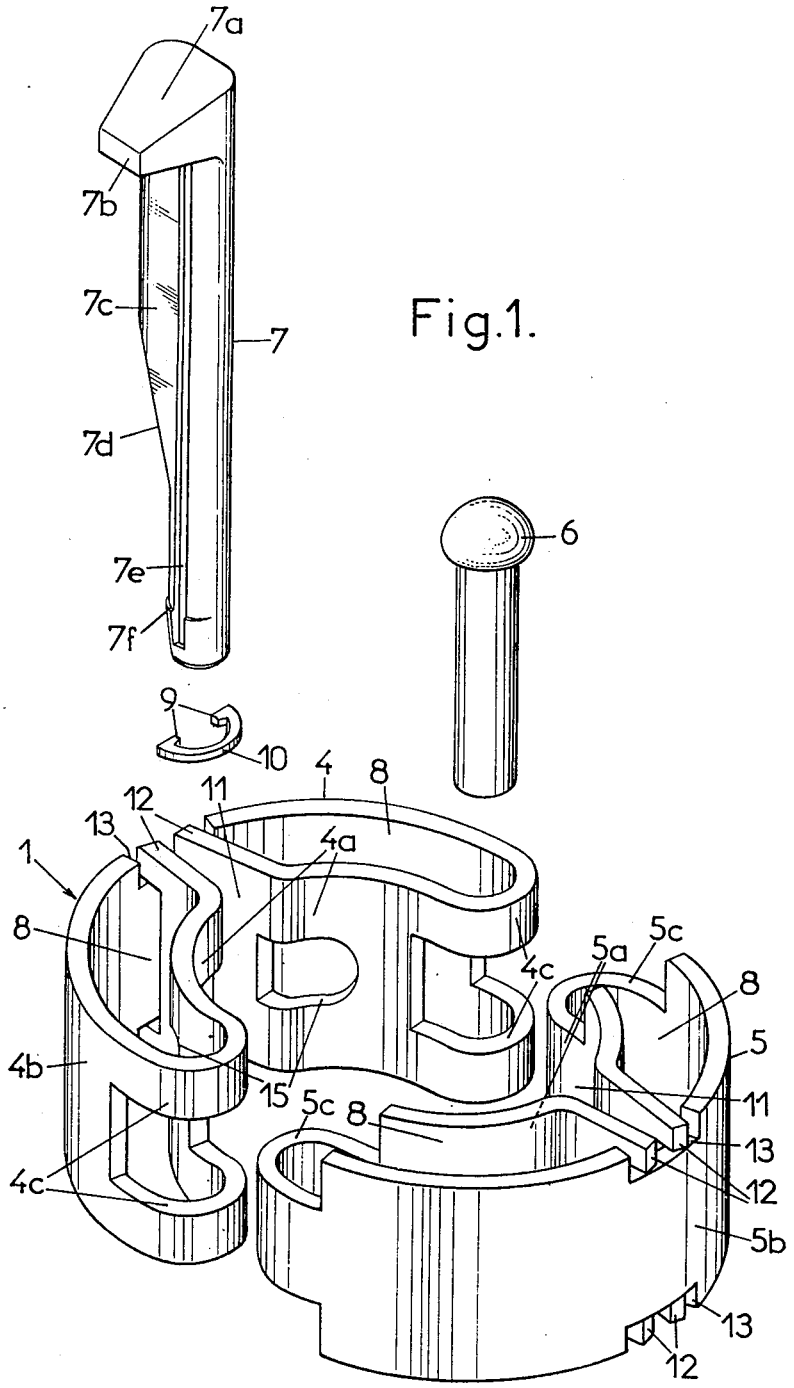
FIG. 1 is an exploded perspective view of an assembly element according to the invention.
Figure 2:
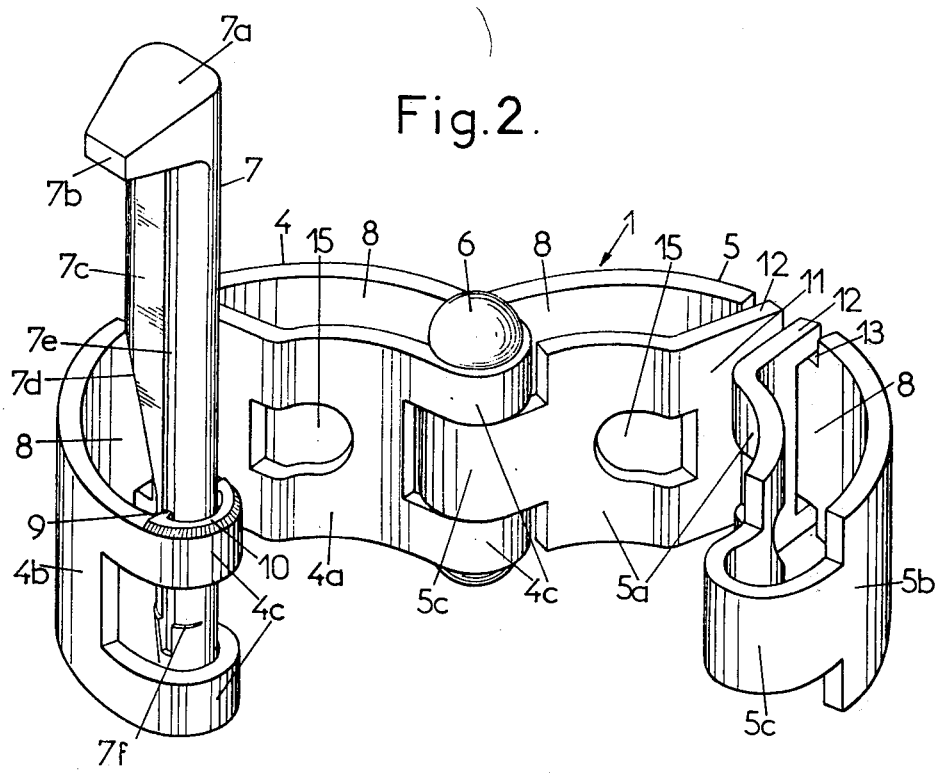
FIG 2 is a perspective view of the assembly element shown in the open position.
Figure 5:
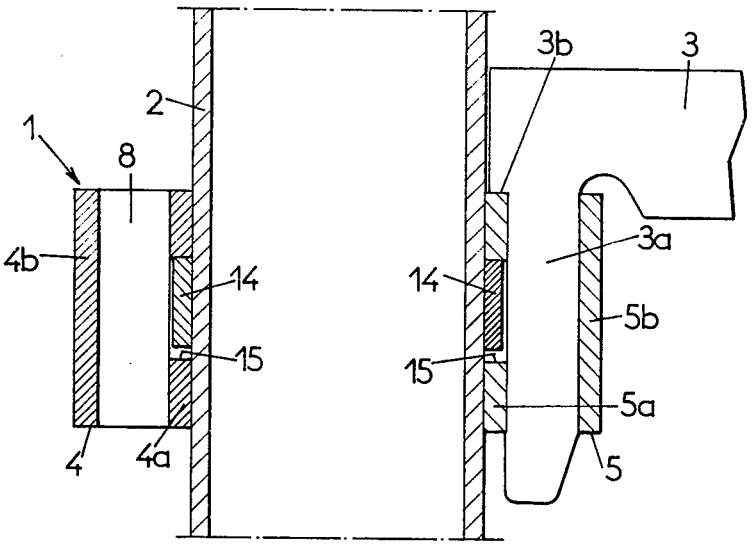
FIG. 5 is a vertical section through the assembly element shown in FIG. 4.
Figure 3:
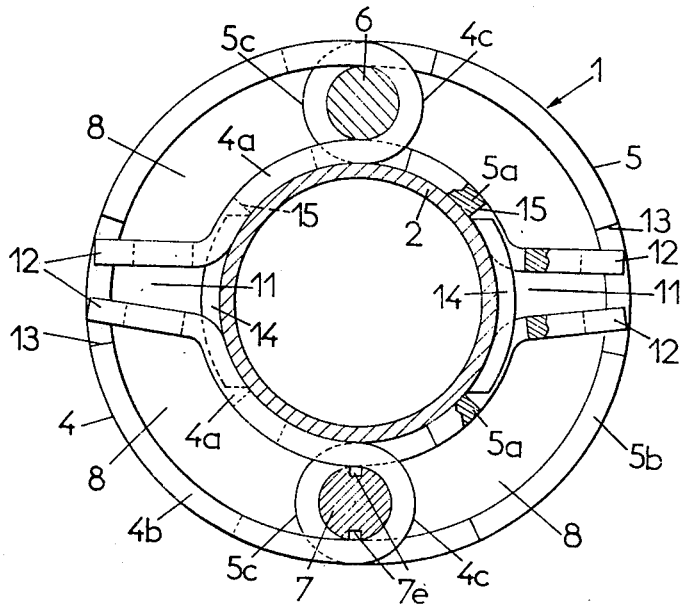
FIG. 3 is a horizontal section through an assembly element shown in the closed position around a tubular vertical upright.
Figure 4:
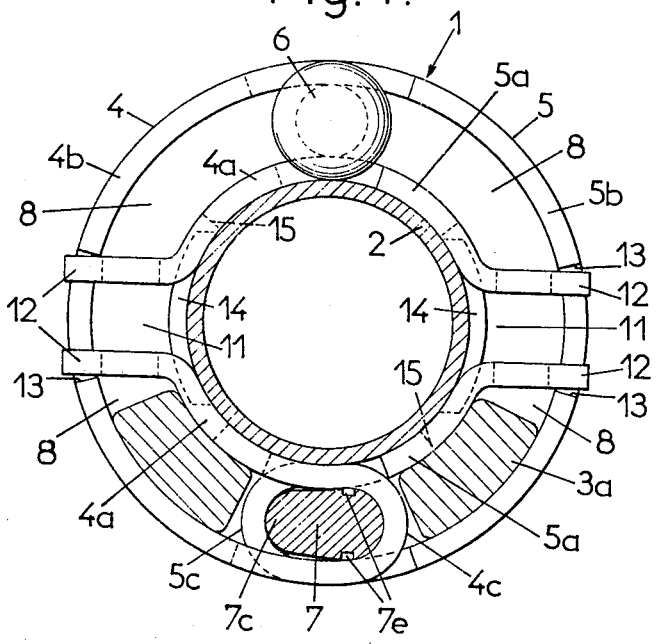
FIG. 4 is a horizontal section through the same assembly element but shown when locked around the vertical upright so as to secure it to two transverse wind-bracing elements.

As shown in FIGS. 3–5, the assembly element, denoted by the general reference 1, can be used (a) for clamping a cylindrical element 2 (such as a vertical tubular upright) after axially or laterally engaging in the upright 2 and (b) for securing upright 2 to a number of transverse connecting and/or wind-bracing elements 3 (such as longitudinal members or horizontal cross-members and/or diagonal members).

As clearly shown in FIGS. 1–5, the assembly element 1 mainly comprises two half-rings 4, 5 interconnected by two pins 6, 7.

Each half-ring 4, 5 has a deformable inner part **4*a*, 5*a* respectively constructed to bear against the surface of upright 2, and an external part 4*b*, 5*b* respectively, constructed to co-operate with the corresponding inner part 4*a*, 5*a* to form spaces 8 to receive the ends 3*a* of transverse wind-bracing elements 3**.

Pin 6 is an ordinary pivot. Pin 7 is constructed so that, when moved with respect to the two half-rings 4 and 5, it tightens them. Advantageously pin 7' is moved axially in either direction, using an ordinary hammer. For this purpose, one end of pin 7 has a head **7*a* formed with a radial prolongation 7*b*** so that it can be axially moved in either direction, using a hammer.

In order to ensure that the axial motion results in tightening the two half-rings 4 and 5, pin 7 has an eccentric part **7*c* connected by a slope 7*d*** to the pin proper.

Pin 7 is also constructed so that when it moves axially with respect to the half-rings 4 and 5, it releases one of them (half-ring 5) so that the two half-rings 4, 5 can open by pivoting around pin 6.

In order to prevent pin 7 coming out of its recess in half-ring 4, the pin has abutment means, advantageously comprising at least one and preferably two diametrically opposite axial grooves 7*a* co-operating with two radial studs 9 secured by welding or the like to half-ring 4. Studs 9 can form part of a half-washer 10 welded to the half-ring 4.

Advantageously, half-rings 4 and 5 are made of steel (e.g. heat-treated to obtain deformability and resilience) and are made from a steel band.

At pins 6 and 7, half-rings 4 and 5 have curved overlapping lugs, i.e. half-collar 4 has four lugs 4*c* and half-collar 5 has two lugs 5*c*.

In order to increase the deformability of the inner parts 4*a*, 5*a* of half-rings 4 and 5, each inner part has an axial slot 11 in its centre region, i.e. substantially between pins 6 and 7.

On each side of slot 11, part 4*a* and 5*a* has radially bent lugs 12 which extend into notches 13 formed in the facing region of the outer part 4*b* or 5*b*. As a result of this feature, lugs 12 abut the edges of notches 13 when the two half-rings 4, 5 are tightened and when some spaces 8 are unoccupied by the ends 3*a* or transverse wind-bracing elements (FIG. 4).

Advantageously, in order axially to lock half-rings 4, 5 on to the relief patterns 14 disposed diametrically opposite one another, patterns 14 engage in apertures 15 formed in the inner part 4*a*, 5*a* of each half-ring 4 and 5. Apertures 15 can extend on each side of slot 11, in which case it is usually necessary to use an opening assembly element which can be engaged sideways.

Alternatively (not illustrated) the opposite method could be followed, i.e. of forming the tubular upright with apertures for engaging relief patterns on the inner part of each half-ring.

Advantageously, in order to improve the strength, in the up-down direction, of the bond between the transverse connecting and/or wind-bracing element 3 and the upright 2, the end 3*a* of the transverse element bears on the inner part 4*a* or 5*a* of the half-ring 4 or 5 under consideration. To this end, end 3*a* has an abutment surface 3*b* co-operating with the upper edge of the inner well 4*a* or 5*a* in question (FIG. 5).

An assembly element 1 constructed in the previously-described manner can always be secured outside the relief patterns 14 formed on upright 2, in which case element 1 can be secured at any required angle. The result is an axial locking action due entirely to clamping between the inner parts 4*a*, 5*a* and the surface of upright 2.

Alternatively element 1 mounted in the aforementioned manner can be placed just above another element 1 which in turn fits on to relief patterns 14.

To prevent pin 7 prematurely moving from the position in which the two half-rings 4, 5 are clamped and locked on to upright 2 (FIG. 4) to the position at which it releases half-ring 5 (FIG. 2), a shoulder 7*f* is disposed so that it hinders but does not prevent pin 7 from coming loose from half-ring 5. Shoulder 7*f* abuts the lower edge of the curved lug 5*c* of half-ring 5.

The following is a description of how an assembly element constructed in the aforementioned manner is assembled or dismantled.

ASSEMBLY

The assembly element is laterally fitted on to the tubular vertical upright, the pin having been released from one of the two half-rings;

The assembly element is brought to the desired level;

The assembly element is closed on to the corresponding relief patterns of the upright by bringing the pin into the position in which it is inserted into the two-half rings. In this position, the assembly element is locked to the relief patterns and the transverse and/or wind-bracing elements can be disposed against the upright and secured;

The assembly element is locked by moving the pin into the position in which it clamps together the two half-rings and thus locks them on to the upright and secures the transverse and/or wind-bracing elements.

DISMANTLING

The pin is moved from the position where it clamps the half-rings to the position where the half-rings are closed and it is still inserted in the two half-rings (owing to its shoulder);

The transverse and/or wind-bracing elements can then be completely or partly withdrawn;

Next, the assembly element can be re-secured if it is only to be partly dismantled, or can be driven out so as to release one of the two half-rings. The pin remains attached to the other half-ring (owing to the abutment means) and the assembly element can open, thus releasing the upright.

Figure 6:
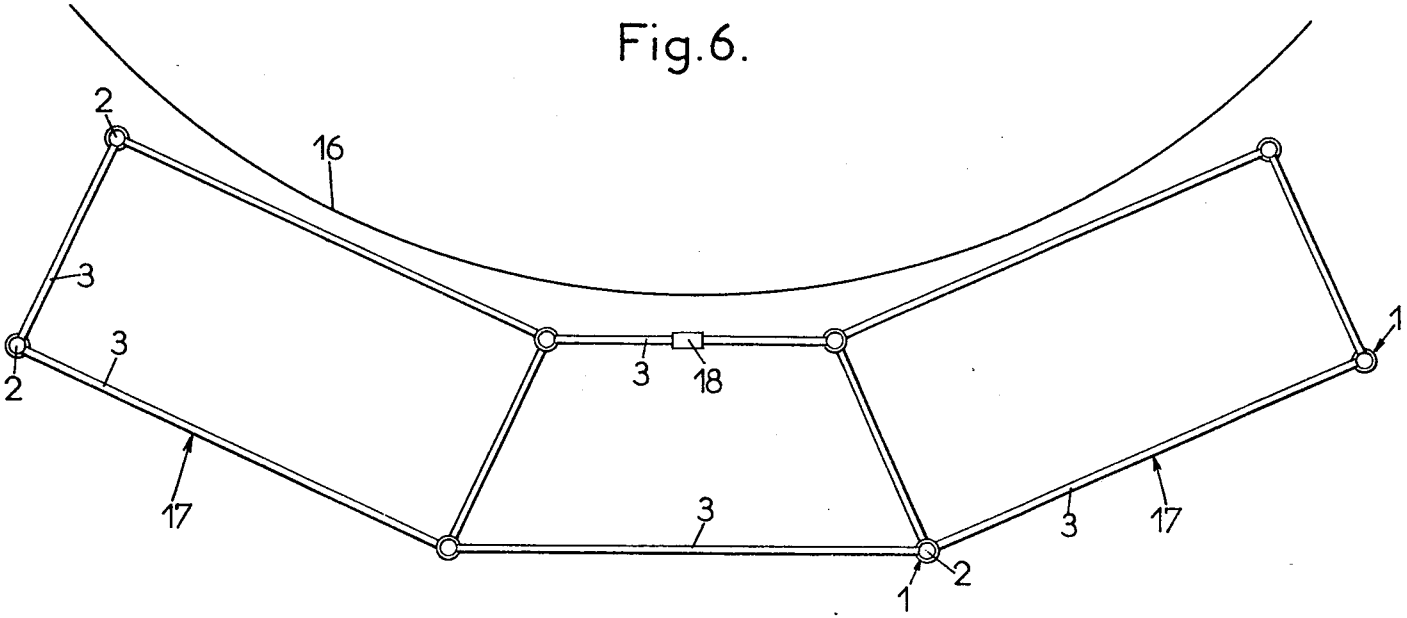
FIG. 6 is a plan view of scaffolding constructed from assembly elements according to the invention.
Figure 7:
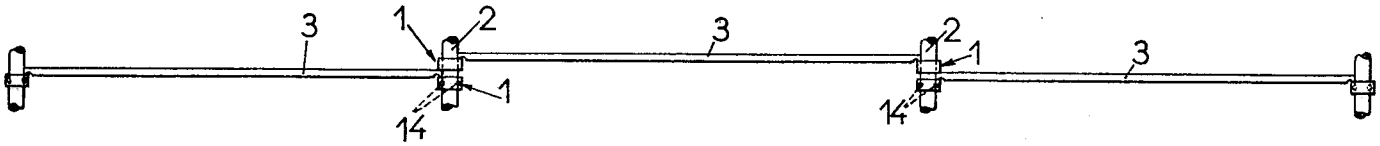
FIG. 7 is a view in elevation showing part of the scaffolding in FIG. 6.

FIGS. 6 and 7 show the use of the invention for constructing scaffolding around a circular building 16.

The scaffolding comprises two rectangular towers 17 constructed from tubular uprights 2 and horizontal connecting longitudinal members 3, uprights 2 and members 3 being secured together by assembly elements 1 fitting on to relief patterns 14 on each upright 2.

The rectangular towers 17 have long longitudinal members and short longitudinal members. In order to connect the two towers 17, they can be attached via external members 3 which are identical with the long members 3 in each tower 17 and are secured to uprights 2 by assembly elements 1 mounted outside patterns 14, in order to join the uprights.

On the inner side, towers 17 are joined by a shortened horizontal member 3 which advantageously comprises a length-regulating device 18. The shortened member 3 is secured to uprights 2 by assembly elements 1 mounted outside patterns 14.

This example clearly illustrates the large number of assembly operations which can be performed using assembly elements according to the invention.

Of course, as the preceding shows, the invention is in no way limited to those applications and embodiments which have been described in detail but includes all variants.

I claim:

1. An assembly element for scaffolding or the like, used for clamping a cylindrical element after said clamping element is engaged axially or laterally on the cylindrical element for securing one or more transverse elements on to the cylindrical, said assembly element comprising two half-rings interconnected by two pins to define a complete ring, each said half-ring having a resiliently deformable inner part adapted to bear against the surface of the cylindrical element and to deform as said inner part bears against that surface, thereby to securely engage that surface and each said half-ring having an outer part adapted to co-operate with said inner part to bound spaces for receiving other elements, at least one of said two pins being so shaped as to be adapted to tighten said two half-rings when said one pin is moved with respect thereto.

2. An assembly element according to claim 1, wherein said one of the two pins is shaped to have a changing profile over its axial length and is shaped so as to engage said half-rings where they are interconnected, and each said half-ring including a respective recess therein in which said one pin is received, so that tightening of said two half-rings is obtained by axial movement of said one pin with respect to said two half-rings for bringing different sections of the changing profile of said one pin into engagement with said half-rings.

3. An assembly element according to claim 1, wherein said inner part of each of said two half-rings is made more easily deformable by an axial slot formed in the center region of said inner part.

4. An assembly element according to claim 2, wherein said inner part of each of said two half-rings is made more easily deformable by an axial slot formed in the center region of said inner part.

5. An assembly element according to any of claims 1, 2 or 3, wherein said inner part of each said half-ring has apertures therein in which reliefs located on a cylindrical element inserted into said assembly element half-ring inner parts can engage.

6. An assembly element according to any of claims 2, 3 or 4, wherein said one pin has abutment means thereon placed and constructed so that said one pin may shift axially with respect to said half-rings, but cannot come completely out of a said recess in one said half-ring.

7. An assembly element according to any of claims 2, 3 or 4, wherein said one pin has a shoulder thereon shaped and disposed so as to inhibit without stopping said one pin coming loose from one said half-ring while permitting said one pin to come loose from said one half-ring upon a relatively greater force being applied to said one pin to effect removal.

8. An assembly element according to any of claims 1, 2, 3 or 4 wherein said two half-rings are each constructed from a steel band.

9. An assembly element according to either of claims 3 or 4, wherein on each annular side of its said slot, said inner part of each said half-ring has radially outwardly extending bent lugs that are spaced apart and that define the said slot between them, notches formed in the facing region of the corresponding said outer part and said notches being so placed that said bent lugs of the corresponding said inner part extend into the respective said notch, and each said notch having and being defined between opposed end walls, and said bent lugs are adapted to abut said end walls upon deformation of the respective said inner part.

10. An assembly element according to claim 1, wherein the end of a transversely extending element that extends transversely of said assembly element has an abutment surface co-operating with an axial edge of a corresponding said inner part.

* * * * *